United States Patent [19]

Raposa et al.

[11] 4,023,883

[45] May 17, 1977

[54] TAP CONNECTOR FOR USE WITH STRANDED WIRE

[75] Inventors: Henry James Raposa; Robert John Tennant, both of Seminole, Fla.

[73] Assignee: AMP Incorporated, Harrisburg, Pa.

[22] Filed: May 8, 1975

[21] Appl. No.: 575,556

[52] U.S. Cl. ..... 339/98
[51] Int. Cl.² ..... H01R 9/08
[58] Field of Search ..... 339/95, 97–99

[56] References Cited

UNITED STATES PATENTS

| | | | |
|---|---|---|---|
| 3,576,518 | 4/1971 | Bazille, Jr. et al. | 339/98 |
| 3,824,527 | 7/1974 | Evans | 339/97 R |

*Primary Examiner*—Joseph H. McGlynn

*Attorney, Agent, or Firm*—Robert W. Pitts; Frederick W. Raring; William J. Keating

[57] ABSTRACT

A connector for establishing electrical contact between two insulated conductors is disclosed. The connector employs a generally V-shaped member having multiple slots extending inwardly from one longitudinal edge of a metallic terminal member. Two slots on the terminal member penetrate the insulation and establish contact with the conductive core of each conductor. A rigid insulating housing anchors the terminal and provides a means for forcing the conductors into the slots. This V-shaped terminal configuration results in the generation of resilient stresses which lead to the establishment of a sufficient slot-type electrical contact with a conductor having a relatively large number of strands comprising its conductive core. This connector is also adapted for use with flat multi-conductor cable.

9 Claims, 9 Drawing Figures

20
74
76
22
24
74
74
74
62'
58'
56'
39'
60
60'
36
56
52'
54'
55
37
42'
62
50
52
46'
46
38
58
48
40
39
54
44
42
37
64
68'
70
17
35
34
70
68
70
66
70
72
30
33
19
26
18
31
72
72

Fig. 4
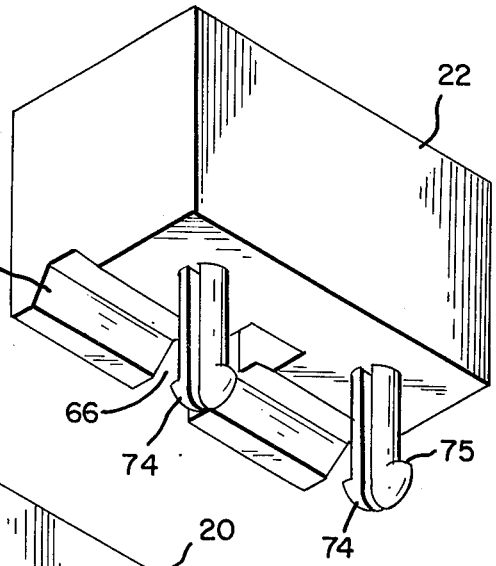
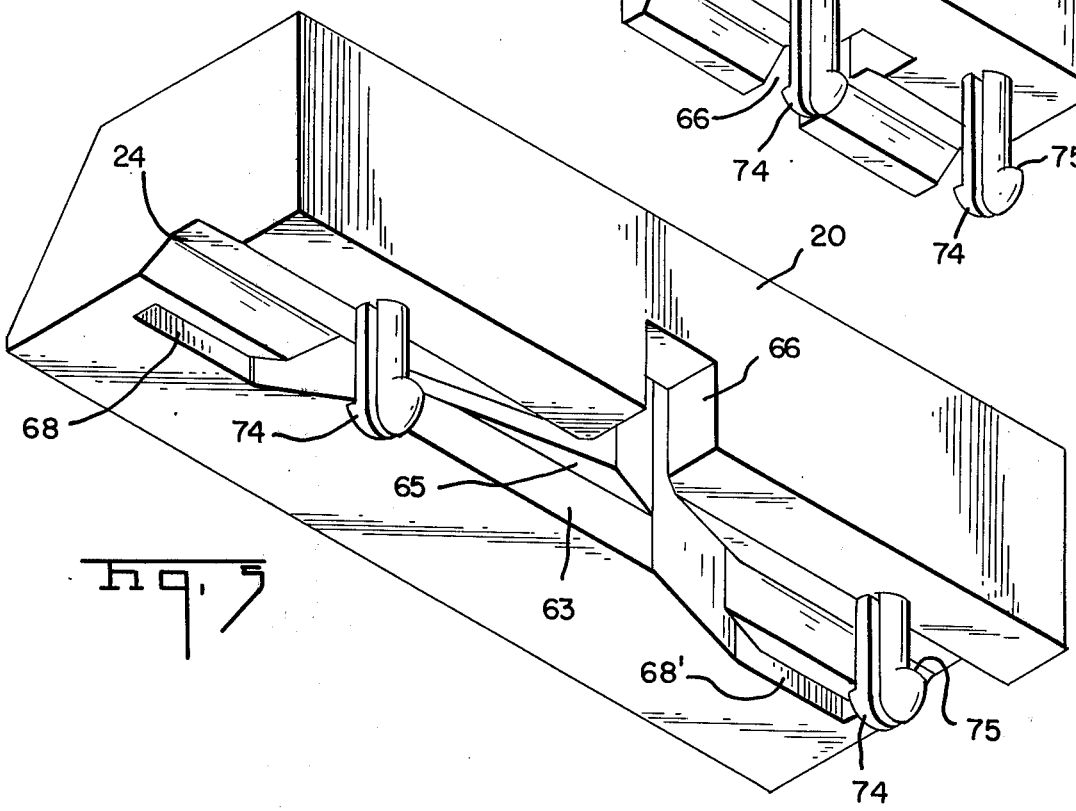
Fig. 5
Fig. 6
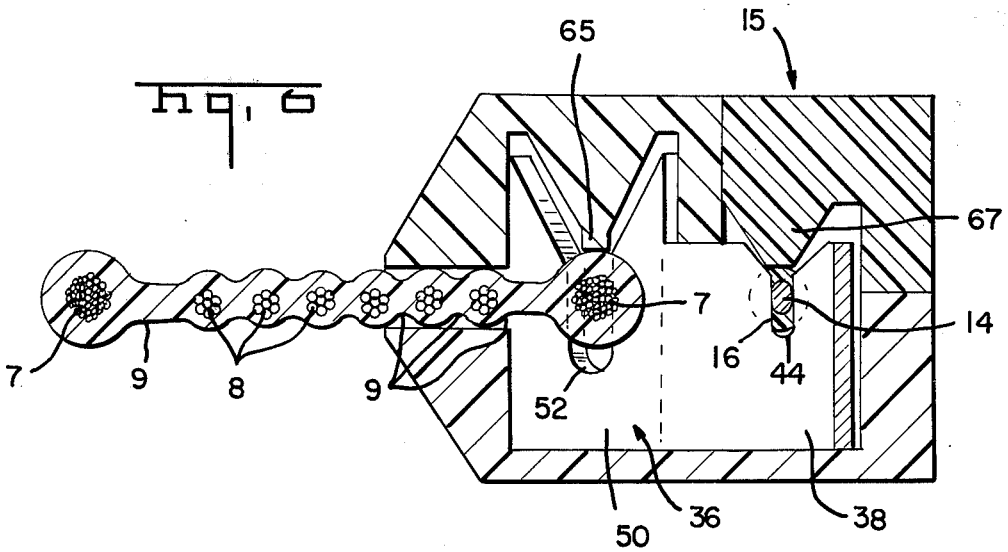

TAP CONNECTOR FOR USE WITH STRANDED WIRE

BACKGROUND OF THE INVENTION

1. Field of Invention

This invention relates to the solderless interconnection of two electrical conductors. This invention also relates to a solderless connector for use with stranded electrical conductors. This connector utilizes a slotted terminal to pierce the insulation and establish electrical contact with the underlying conductive core.

2. Description of the Prior Art

Numerous slot-type electrical connectors are known. Many connectors such as the one shown in U.S. Pat. No. 3,118,715 utilize a slotted terminal to form a tap between two conductors. U.S. Pat. No. 3,824,527 discloses and claims a slotted terminal which is generally V-shaped with slots in the opposed legs.

SUMMARY OF THE INVENTION

Among the objectives of this invention is the use of a slotted terminal capable of establishing a suitable contact when used with multi-stranded wires. It is an object of this invention to use such a terminal to form a tap connection between a multi-stranded wire and a tap conductor which can be either a solid wire or a smaller stranded wire. Another object of this invention is to furnish a connector which may be used with multi-conductor cable where one of the interconnected wires runs along one lateral edge of the cable. An additional object of this invention is to utilize a snap-in housing which serves to establish the connection by pushing the respective conductors into the terminal slots. By using such a snap-in housing, the need for complicated application tooling does not exist. One further object of this invention is to utilize a single terminal for establishing contact with both wires. The terminal configuration utilized is one in which the stresses acting on one conductor are isolated from those acting on the other conductor.

In order to achieve these and other objects of this invention, a V-shaped terminal having its ends firmly anchored in a rigid housing is used to establish contact with a conductor having a relatively large number of strands. A snap-in housing having appropriate means for pushing the conductors into the terminal slots and also having means for anchoring the terminal is uitilized. A single terminal having four slots extending inwardly from one longitudinal edge of the terminal is used. At least two of the slots are located in separate oblique portions of the terminal so that a multi-stranded wire can be inserted simultaneously into both slots. A terminal configuration adapted to isolate the stresses acting on the two wires inserted into the single terminal is used.

BRIEF DESCRIPTION OF THE DRAWING

FIG. 4 is a view of the tap cover.

FIG. 5 is a view of the upper housing cover which acts in conjunction with the tap cover.

FIG. 6 is a view along a section 6—6 in FIG. 1 which extends through the central tap connector portion.

DETAILED DESCRIPTION OF THE FIGURES

Figure 1:
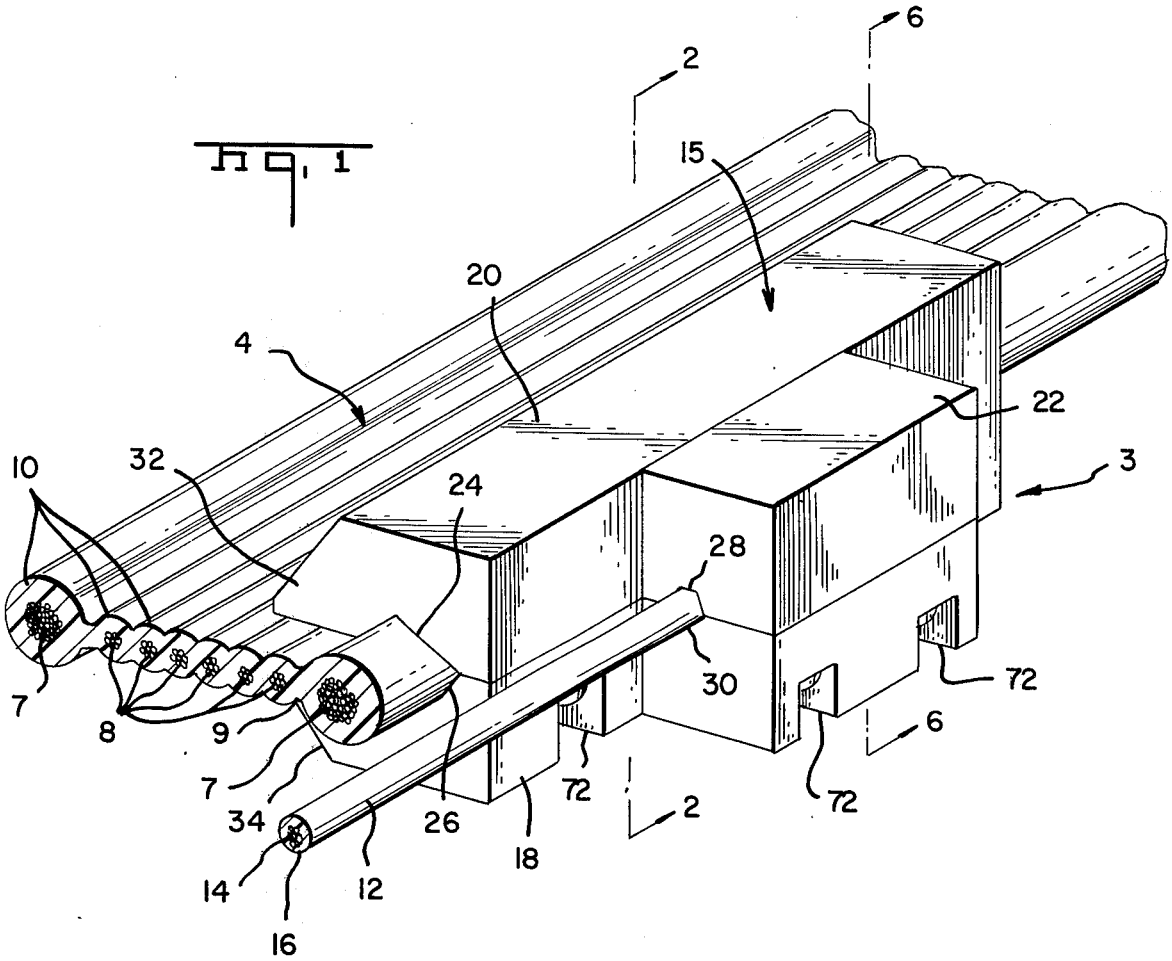
FIG. 1 is a perspective view of the tap connector when used with a multi-conductor cable.

FIG. 1 shows the preferred embodiment of this invention as utilized with a form of flat multi-conductor cable 4. This particular cable is often referred to as ribbon cable. The ribbon cable shown here has six smaller conductors 8 located in the interior of the cable with two larger conductors 7 extending laterally on either end. The conductors used in this ribbon-cable may be either solid round wires or stranded wires. Ribbon cable may be used as part of the circuit in an automobile wiring system, in which case, the larger conductors on either end would generally be stranded wires. For one particular application with which this tap connector could be used, these larger conductors would be No. 10 AWG wires having 37 copper strands. The smaller interior conductors might be No. 22 AWG solid or seven strand copper wire. The tap conductor 12 shown here would be AWG No. 18 seven stranded or solid copper wire. The flat or ribbon cable 4 shown here has an insulation 10 which consists of the insulation surrounding each individual conductor plus a web 9 joining the insulation on adjacent conductors. It should be noted that the spacing between one of the end conductors 7 and the adjacent interior conductor 8 is greater than the spacing between any two interior conductors. The insulation surrounding these conductors would be of a suitable plastic such as polyvinyl chloride.

The housing 15 shown in FIG. 1 is formed from a rigid insulating material. The housing contains suitable channels for receipt of both the tap wire 12 and the through conductor 7. The housing has a base portion 18, a housing cover 20 and a housing tap cover 22. The conductors lie parallel to the mating surfaces of three housing components. The housing cover 20 and base 18 each have a segment 32 which abuts the interior portion of the ribbon cable when the connector is in its assembled state. These sections 32 are not flush as are the other segments of the housing.

Figure 3:
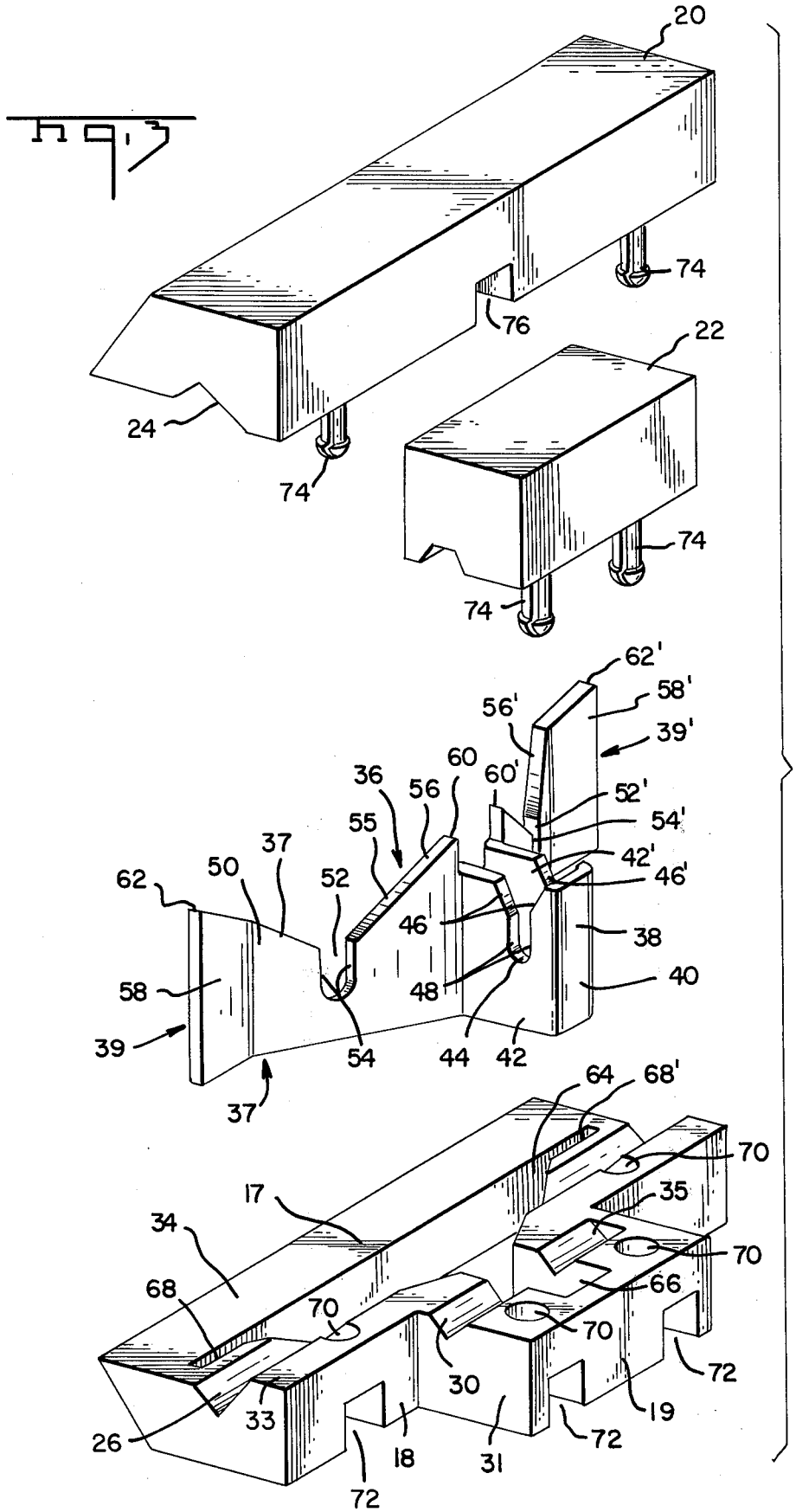
FIG. 3 shows an exploded view of the terminal and the three components of the rigid housing.

FIG. 3 is an exploded view of the connector showing the three housing components when viewed from above and also showing the terminal used in the preferred embodiment. The terminal used in the preferred embodiment is formed of a resilient conductive metal such as number 4 hard brass. The drawings depict the connector in an enlarged state and the actual connector would utilize a terminal having a thickness of 0.028. This terminal has longitudinal edges 37, 37′ which are longer than end edges 39, 39′. The bottom edge 37 is contained in one plane while the upper edge 37 comprises a number of inclined segments. The terminal is also formed about a number of bend lines at various longitudinal stations. In the preferred embodiment the terminal has four slots extending inwardly from the upper longitudinal edge 37. The terminal is bent about its center line so that the innermost slots 44 and 44′ are aligned along a first straight line. The outermost slots 52, 52′ are aligned along a second straight line which would be parallel to the first straight line. In this way, one conductor can be inserted into the two innermost slots while a second conductor may be placed parellel to the first conductor and in the two outermost slots.

In the preferred embodiment of the terminal, the central segment 38 is U-shaped with parallel sidewalls 42, and 42'. Each sidewall has a slot 44, 44' and these two slots, are aligned along the first straight line. The edges 48 and 48' of each slot are parallel to each other over most of the slot. Each slot, however, has entrance edges which are inclined with respect to the slot edges 48, 48' and form an opening which is wider than the major portion of the slot. This central segment 38 is intended for use in establishing contact with the tap conductor.

The preferred embodiment of the terminal has two oblique sections 50, and 50'. These first and second segments 50, 50' each have one slot 52, 52'. These slots have edges 54, 54' which are parallel to each other. Slots 52, 52' are aligned along a second straight line which is parallel to the first straight-line. It should be noted, however, that the edges of the slot lie in the planes of the oblique segments, and the slots themselves are not parallel as are the two innermost slots 48, and 48'. Slots 52, 52' are, however, equally spaced from central portion 38 so that a straight line can be drawn which will pass through slots 52, 52' and will also be parallel to a line through slots 44, 44'.

Upper longitudinal edge 37 has inclined portions extending outwardly from each slot. These inclined portions serve as entrance edges as well as providing surfaces for penetration of the web 9 of the ribbon cable.

Terminal 36 has end flanges 58, 58' which join oblique segments 50 and 50'. These end flanges are remote from central section 38. These end flanges are bent with respect to segments 50 and 50' and lie in a plane parallel to the first and second parallel lines.

Figure 8:
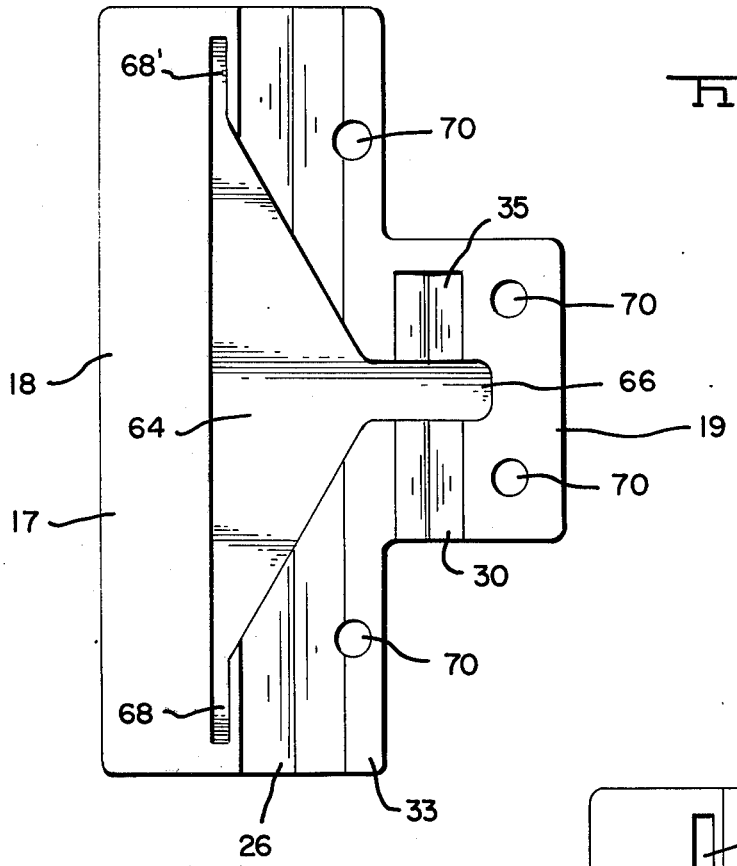
FIG. 8 shows the details of the lower housing.
Figure 9:
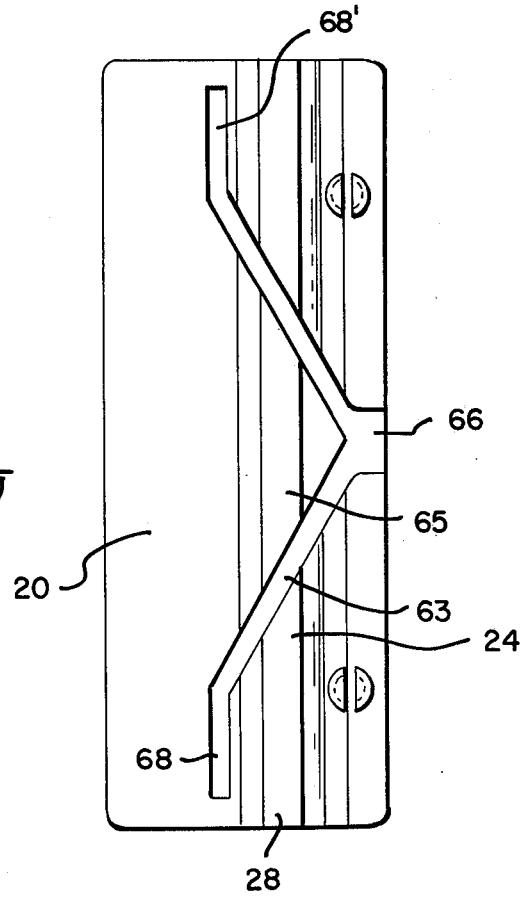
FIG. 9 shows the terminal receiving cavity and the stuffer portion of the upper cable housing.

The telescopic view of FIG. 3 shows the three part housing as well as terminal 36. The perspective view shown in FIG. 3 shows the housing components when viewed from above. The housing base 18 is seen with the inner structure partially exposed. FIGS. 4 and 5 show the tap cap 22 and upper housing cover 20 when viewed from below. The inner structure of the upper housing is therefore partially exposed. FIG. 8 is a plan view of the housing base 18 showing tee lower terminal cavity 64 and channels 26 and 30. FIG. 9 is a view of the upper housing cover from below, showing the upper cavity 63 and the wire stuffer 65. Together, all of these Figures show the respective details of the three housing components.

Figure 2:
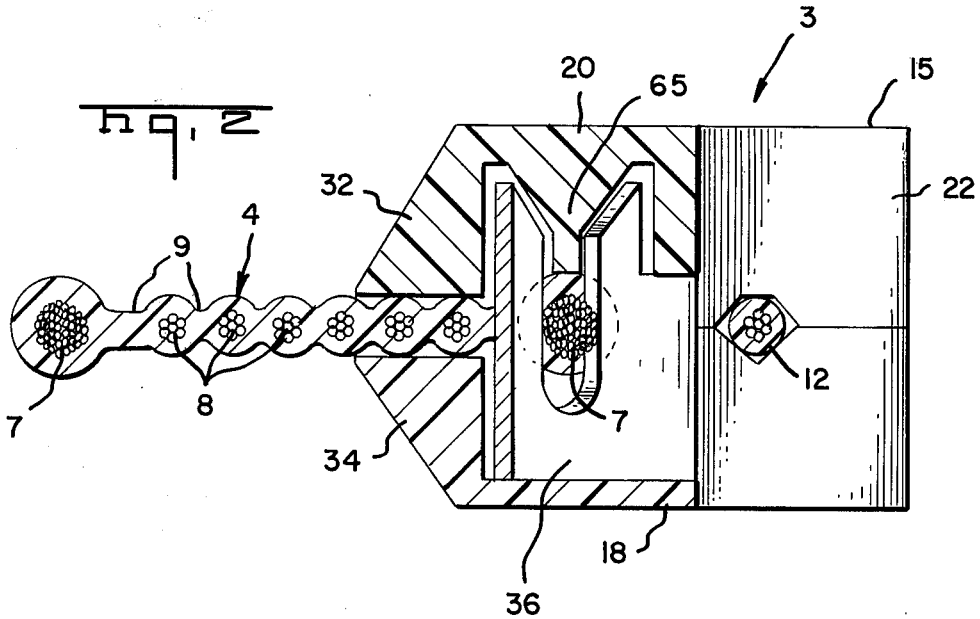
FIG. 2 is a view taken along section 2—2 of FIG. 1 which extends through one of the oblique segments of the terminal.

The housing base 18 has a section 17 adapted to receive one of the wires in the ribbon cable. The base tap portion 19 is located adjacent to section 17 and provides means for receiving a tap wire 12. Base section 17 has an open cavity 64 which is essentially triangular with an elongated recess at each apex of the cavity. An insert 66 extends as part of cavity 64 into tap section 19. This insert is dimensioned to receive the central tap section 38 of terminal 36. Cavity 64 has grooves extending from the other two angles of the triangle. These two grooves 68 lie in the same plane. Adjacent to the plane of the grooves 68 is a channel 26 which extends along the entire length of the housing base 18. This channel is dimensioned so that it can hold the lower half of the cable conductor 7. The channel opens onto the mating surface of the base 18. It should be noted that the surfaces on either side of the channel are not in the same plane. Ledge 33 extending between channels 26 and tap section 19 is elevated with respect to ledge 34 which forms the left side of the base as shown in FIG. 3. When the housing cover 20 is brought into contact with base 18, ledge 33 will abut a corresponding surface on the bottom of cover 20. Ledge 34 will be spaced from a similar surface on cover 20. This spacing allows room for passage on the interior portion of the ribbon cable 4, as can be seen in FIG. 2. Tap section 19 also has a channel 30. This channel extends substantially across tap section 19 but opens only on face 31. This channel 30 is dimensioned for receipt of tap conductor 12. The end of the tap conductor will abut channel face 35. Both channel 26 and channel 30 extend completely across cavity 64. The channels intersect the cavity at points corresponding to the location of the slots in terminal 36. FIG. 3 shows this quite clearly.

FIG. 9, which shows the bottom surface of housing cover 20, shows that the upper cavity 63, is not triangular like lower cavity 64. Upper housing cover 20 has a stuffer 65 located next to cavity 63. This stuffer extends across upper channel 28 and is used to force the cable conductor 7 through the slots 52, 52' of terminal 36. A similar stuffer is employed with the tap section. This tap stuffer 67 is shown in FIG. 6. Note that cavity 63 is only slightly wider than terminal segments 50 and 50'.

Both the tap cap 22 and upper housing cover 20 have two tabs 74 extending from their lower surface. These tabs comprise opposed cantilever members which have interlocking surfaces 75 on their ends. The housing base has four holes 70 spaced to receive the tabs 74. As the tabs 74 are inserted into holes 70, the cantilever arms are flexed inwardly. After passing through the holes 70, these tabs enter recesses 72 on the lower surface of the housing base 18. These recesses 72 are larger than holes 70 and allow the cantilever arms to flex outwardly. The interlocking surfaces 75 can then abut appropriate shoulder on the lower surface of housing base 18. The housing cover 20 and tap cap 22 are then securely fixed to the housing base 18.

Figure 7:
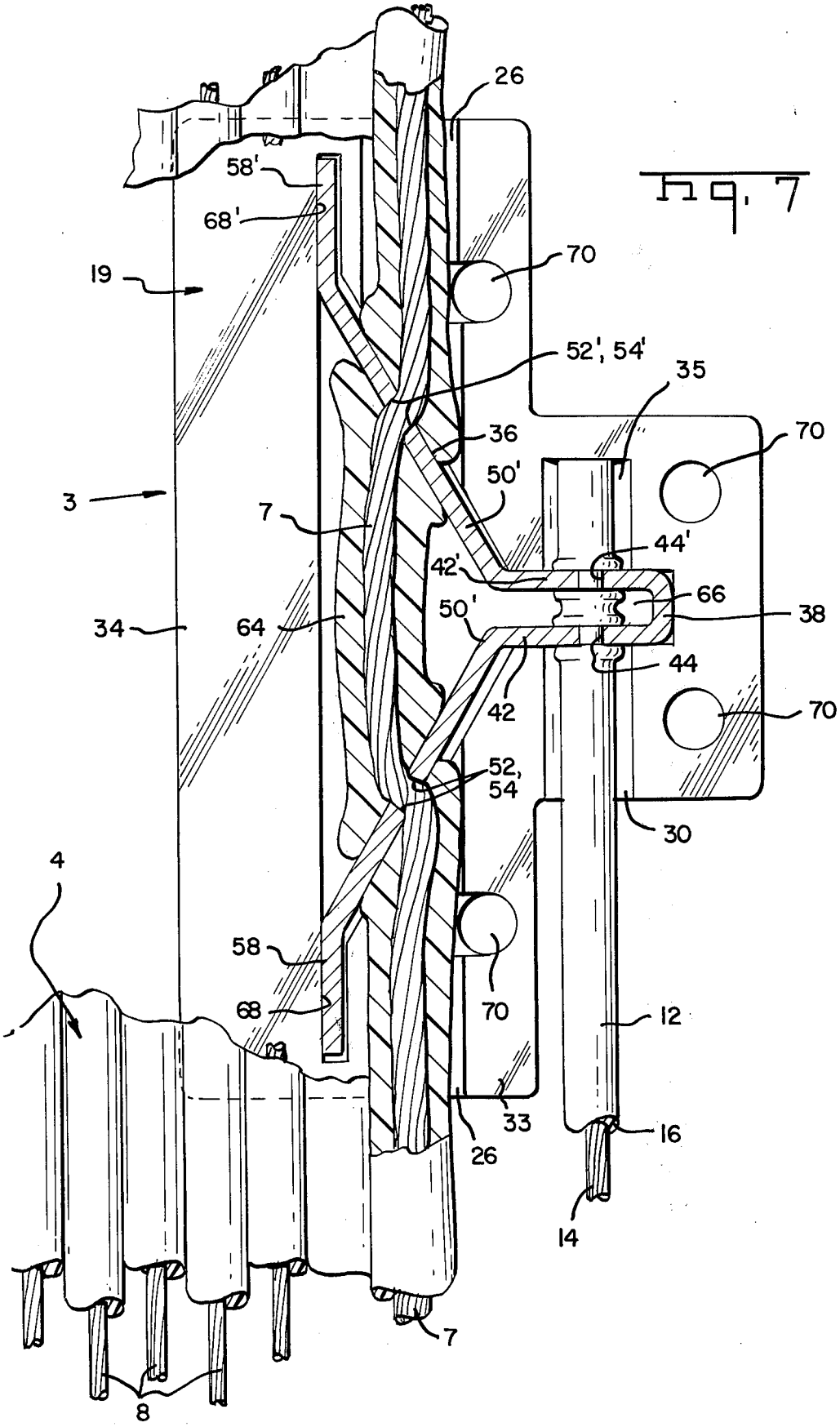
FIG. 7 is a top view showing the lower housing with the terminal and a tap conductor extending therethrough.

FIG. 7 is a plan view of the housing base 18 with a terminal 36 positioned in cavity 64. This Figure also shows a tap conductor 12 positioned in slots 44 and 44' and a through conductor 7 positioned in slots 52, 52'. The interior conductors 8 in ribbon cable 4 are also shown. The terminal 36 fits into cavity 64 adjacent to the righthand edges, when viewed in FIG. 7. Central section 38 of the terminal fits into insert 66 across channel 26. The terminal 36 abuts the sides of the cavity at the center of U-shaped section 38 and along the end flanges 58, 58'. End flanges 58, 58' fit into grooves 68, 68'. It should be noted that the ends of flanges 58, 58' do not abut the ends of the grooves 68, 68'. This permits some degree of lateral movement in the direction of wire 7.

Slots 44 and 44' are aligned with the axis of channel 30 and with the axis of tap conductor 12. Slots 52, and 52' however, are not aligned with the axis of channel 26. These slots do lie along the axis of channel 26, however, since terminal sections 50, 50' are not normal to the axis of channel 26 and the slots 52, 52' in these sections cannot be said to be aligned with the axis of channel 26. In spite of this lack of alignment, a conductor 7 positioned in channel 26 may be inserted into both slots 44 and 44' and FIG. 7 shows that this conductor remains essentially straight. Insertion of conductor 7 into oblique slots 52, 52' results in a kinking effect in the conductor 7 in the neighborhood of these slots. Conductor 7, therefore, does not lie in a truly straight line.

Experience has shown that an electrical contact cannot be satisfactorily established with a conductor containing a large number of strands by using conventional parallel slots such as 44 and 44'. Suitable connections have been established by using conventional parallel slots in connection with conductors having 7 strands. An AWG No. 10 wire has 37 strands and conventional parallel slots have proved incapable of establishing a satisfactory contact with a conductor containing this many strands. If the slots are made narrow with respect to the diameter of a conductive core, the slots tend to sever a number of strands resulting in an unsuitable connection. A slot which is only slightly narrower than the conductor has heretofore been proved incapable of contacting a sufficient number of strands. In either case, the strands in a wire tend to line up in the slot avoiding contact with the slot edges and diminishing the contact pressure attainable. The kinking effect achieved by using divergent slotted sections offers advantages with stranded wire. Sufficient contact has been attained using a V-shaped terminal in conjunction with wires having substantially more than seven strands. This kinking effect provides four distinct points which establish contact with a wire. It also tends to keep the insulation intact to a greater degree than a parallel slots would. By remaining intact, the insulation helps prevent the strands from lining up within the slot.

Slots 52 and 52' are only slightly narrower than the diameter of the conductive core of wire 7. A slot width which is 95% of the conductive core diameter can be used. It is important, however, that the slot geometry be maintained in the presence of the stresses induced by insertion of the wire into the slot. Flanges 58 and 58' act to maintain the structural integrity of the slot. Deformation of the outer edge of slots 52 and 52' is resisted by flanges 58 and 58'. These flanges provide needed structural integrity while simultaneously permitting a reduction in the depth of the terminal. This need for a terminal with the minimum depth can be appreciated by examining the ribbon cable. While the terminal must penetrate the insulation forming web 9, the terminal must not contact or sever any of the interior conductors 8. An extension of the terminal in the plane of segments 50 and 50' would therefore be inappropriate. In this way, the presence of a number of closely spaced conductors would dictate the use of a terminal having a minimum depth.

The terminal in the preferred embodiment of this invention is shaped so that the stresses acting on tap conductor are, to a large degree, isolated from the stresses acting on conductor 7. Here, this isolation is accomplished because of the presence of bends between the parallel sections of segment 38 and divergent sections 50 and 50'.

Changes in construction will occur to those skilled in the art and various apparently different modifications and embodiments may be made without departing from the scope of the invention. The matter set forth in the foregoing description and accompanying drawings is offered by way of illustration only.

We claim:

1. A connector for establishing electrical contact with an insulated conductor, said connector comprising:

a single terminal of resilient conductive metal, said terminal being bent so that first and second segments of said terminal occupy intersecting planes, said first and second segments each having one slot extending inwardly from one longitudinal edge and having a width only slightly less than the diameter of the conductive core of said conductor, said slots being equally spaced from the intersection of said planes, first and second flanges on said terminal, said flanges being respectively located adjacent to said first and second segments and comprising the opposite end portions of said terminal, said flanges being bent with respect to said segments so that said flanges are generally parallel to the line joining said two slots, and an insulating housing having means for supporting said terminal, said housing having anchoring means for supporting both sides of said flanges, whereby said conductor may be inserted into both of said slots so that electrical contact may be established between said terminal and said conductor since said slots penetrate said insulation establishing contact with the underlying conductive core.

2. A connector as set forth in claim 1 wherein said anchoring means comprises grooves in said housing for receipt of the longitudinal edges of said flanges, said grooves being slightly longer than said flanges so that said flanges are capable of slight lateral movement.

3. An electrical connector for establishing a tap connection between first and second insulated conductors, said connector comprising:

a single terminal of resilient conductive metal having four slots extending inwardly from a longitudinal edge of said terminal, said terminal being bent so that portions on either side of the center are located in intersecting planes and the two innermost slots are aligned along a first straight line, each having a width which is less than the diameter of the conductive core of said first conductor, and the two outermost slots lie along a second straight line which is parallel to said first straight line, each of said two outermost slots having a width which is only slightly less than the diameter of the conductive core of said second conductor, and an insulating housing having upper and lower mateable halves, each half having first and second parallel channels for receipt of first and second conductors respectively and a continuous cavity for receipt of the longitudinal edges of said terminal, said channels crossing said cavity at locations corresponding to the locations of said slots in said terminal, whereby said first and second conductors are electrically connected by positioning said terminal in said cavity and said conductors in said channels and bringing said halves into abutting relationship so that said slots penetrate the insulation on said conductors and establish elecrical contact with the underlying conductive core.

4. An electrical connector for establishing a tap connection between an insulated tap wire and one of the conductors in a multiconductor cable containing a plurality of individual conductors positioned in a single plane and embedded in a common insulating covering, said connector comprising:

a terminal of resilient conductive metal, said terminal having first and second segments for receiving a cable conductor disposed on opposite sides of a central segment for receiving said tap conductors, each of said first and second segments having a single slot, with a width only slightly less than the diameter of the conductive core of said one cable conductor, extending inwardly from one longitudinal edge of said terminal and said central segment having two slots, each having a width which is less than the diameter of the conductive core of said tap conductor, extending inwardly from said longitudinal edge, said central segment being bent between said two central slots so that said central segment is substantially U-shaped with parallel legs and said two innermost slots are aligned along a first straight line, said first and second segments being bent with respect to said central segment so that said first and second segments lie in intersecting planes with the respective slots in said first and second segments lying on a second straight line which is parallel to said first straight line, an insulating housing having upper and lower mateable halves, each half having a cavity for receiving the upper and lower longitudinal edges of said terminal respectively, each half also having separate parallel longitudinal channels for receipt of said cable conductor and said tap conductor, said channels crossing said cavities at the points corresponding to the location of said slots in said terminal, whereby said conductors may be positioned in said channels and said terminal in said cavities so that said upper and lower housing halves may be mated so that said slots displace the insulation around said conductors and electrical contact is established with the underlying conductive core.

5. An electrical connector for establishing a tap connection between a stranded-wire through conductor contained in a flat multi-conductor cable and a smaller stranded-wire tap conductor, said connector comprising:

a terminal of resilient conductive metal, said terminal having first and second segments, for establishing contact with said through conductor, disposed on opposite sides of a central segment, which is used for establishing contact with said tap conductor, said central segment having two slots, each having a width which is less than the diameter of the composite conductive core of said tap conductor, said first and second segments each having a single slot, which has a width ony slightly less than the composite conductive core of said through conductor, all of said slots extending inwardly from one longitudinal edge of said terminal, bend lines on said terminal at a number of longitudinal stations, said bend lines being generally parallel to said slots, said central segment being formed along certain bend lines into a generally U-shaped configuration with said two central slots aligned along a first straight line, said first and second segments each being bent along other bend lines with respect to said central segment so that said first and second segments lie in intersecting planes with said slots in said first and second segments lying along a second straight line which is parallel to said first straight line, first and second flanges on said terminal, said flanges being respectively located adjacent to said first and second segments and comprising the opposite end portions of said terminal, said flanges being bent with respect to said segments so that said flanges are parallel to said first and second straight lines, an insulating housing having upper and lower mateable halves, each half having first and second parallel channels, for receipt of said tap conductor and said through conductor respectively, each half also having a continuous cavity for receipt of the upper and lower longitudinal edges of said terminal respectively, with said channels and said cavities extending along the mating faces of said upper and lower halves, said channels crossing said cavities at locations corresponding to the locations of said slots in said terminal, and grooves on either end of said cavities, said grooves occupying a location in said cavity corresponding to the location of said flanges on said terminal, said grooves being longer than said flanges so as to permit lateral movement of said flanges in said grooves, whereby said tap and through conductors are electrically connected by positioning said terminal in said cavities and said conductors in said channels and bringing said halves into abutting relationship so that said slots penetrate the insulation on said conductors and establish electrical contact with the underlying stranded conductive core.

6. A connector as set forth in claim 5 wherein said upper housing half comprises two separate portions, a tap conductor cap portion containing said first channel and a through conductor cap portion containing said second channel with portions of said continuous cavity being contained in each cap portion.

7. A connector as set forth in claim 5 wherein said upper housing half has integral tabs dimensioned to be inserted into mating recesses on said lower half so that said upper and lower housing halves may be interlocked.

8. A connector as set forth in claim 5 wherein said upper housing has integral stuffer means for forcing said conductors into said slots as said mating halves of said housing are brought into contact.

9. A connector as set forth in claim 8 wherein said integral stuffer means comprise portions on said upper housing half adjacent to said upper cavity on said upper half, said upper cavity being only slightly wider than said terminal in the neighborhood of said first and second terminal segments.

* * * * *